US005775062A

United States Patent [19]

Ghini et al.

[11] Patent Number: 5,775,062

[45] Date of Patent: Jul. 7, 1998

[54] METHOD OF CONTINUOUSLY FEEDING WRAPPING ELEMENTS IN SHEET FORM TO A USER MACHINE

[75] Inventors: Marco Ghini, S. Lazzaro di Savena; Michele Ferrari, Bologna; Alessandro Minarelli, Bazzano, all of Italy

[73] Assignee: G.D Societa' per Azioni, Italy

[21] Appl. No.: 662,935

[22] Filed: Jun. 12, 1996

[30] Foreign Application Priority Data

Jun. 14, 1995 [IT] Italy ..... BO95A0303

[51] Int. Cl.[6] ..... B65H 3/42; B31B 1/80

[52] U.S. Cl. ..... 53/461; 53/389.1; 493/315

[58] Field of Search ..... 53/461, 389.1, 53/571; 493/317, 315; 271/95, 120

[56] References Cited

U.S. PATENT DOCUMENTS

| | | | |
|---|---|---|---|
| 4,596,545 | 6/1986 | Greenwell | 493/315 |
| 5,102,385 | 4/1992 | Calvert | 493/317 X |
| 5,215,515 | 6/1993 | Bershadsky | 493/315 |

FOREIGN PATENT DOCUMENTS

| | | |
|---|---|---|
| 0060774 | 9/1982 | European Pat. Off. . |
| 0592818 | 4/1994 | European Pat. Off. . |
| 1374691 | 1/1973 | United Kingdom . |
| 1331330 | 9/1973 | United Kingdom . |
| 1429750 | 3/1976 | United Kingdom . |
| 1565922 | 4/1980 | United Kingdom . |
| 2108935 | 5/1983 | United Kingdom . |

*Primary Examiner*—James F. Coan
*Attorney, Agent, or Firm*—Klauber & Jackson

[57] ABSTRACT

A method of continuously feeding wrapping elements in sheet form to a continuously-rotating input roller of a wrapping machine, whereby each element is withdrawn from the output of a feedbox by a curved gripping member rolled onto the element at the output of the feedbox, is fed along a given path by moving the gripping member continuously along the path, and is released onto the conveying surface of the input roller by rolling the gripping member on the surface of the roller.

6 Claims, 3 Drawing Sheets

METHOD OF CONTINUOUSLY FEEDING WRAPPING ELEMENTS IN SHEET FORM TO A USER MACHINE

BACKGROUND OF THE INVENTION

The present invention relates to a method of continuously feeding wrapping elements in sheet form to a user machine.

More specifically, the present invention relates to a method of feeding wrapping elements in sheet form to a continuous user machine presenting a continuously-rotating input conveyor roller for the wrapping elements.

In general, wrapping elements are supplied to a continuous user machine by withdrawing the elements successively and intermittently from a feedbox, and feeding them in steps to an intermediate feed device located between the feedbox and the user machine and for accelerating the elements to feed them continuously to the input roller of the user machine.

The above method presents several drawbacks, mainly due to the use of intermittent devices, which are relatively noisy and incapable of operating at relatively high speed.

SUMMARY OF THE INVENTION

It is an object of the present invention to provide a method of continuously supplying wrapping elements in sheet form, designed to overcome the aforementioned drawbacks.

According to the present invention, there is provided a method of continuously feeding wrapping elements in sheet form to a user machine presenting an input conveyor in turn presenting a continuously-moving conveying surface for successively receiving said elements; the method comprising the steps of successively and continuously withdrawing said elements from an output end of a feedbox by means of respective gripping members; feeding said gripping members, together with the respective elements, along a given path; and releasing the elements onto said conveying surface; the method being characterized in that each gripping member presents a curved peripheral gripping surface for a respective said element; said withdrawing step being performed by withdrawing each element progressively from said output end by rolling the gripping surface of the respective gripping member along the output end; and said releasing step being performed by progressively releasing each element onto said conveying surface by rolling the gripping surface of the respective gripping member on the conveying surface.

According to a preferred embodiment of the method according to the present invention, said gripping surface is a generally cylindrical surface presenting an axis; said withdrawing step comprising, for each said element, the substeps of moving the axis of the respective gripping member along a first trajectory parallel to said output end and at a first speed, and rotating the respective gripping member about said axis so as to impart to the respective gripping surface a second surface speed, about said axis, equal to twice said first speed.

Preferably, said releasing step comprises, for each said element, the substeps of moving the axis of the respective gripping member along a second trajectory parallel to said conveying surface; and rotating the respective gripping member about said axis so as to impart to the respective gripping surface a third surface speed, about said axis, equal to a traveling speed of the conveying surface; said axis being moved along said second trajectory at a fourth speed equal to half said third speed.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
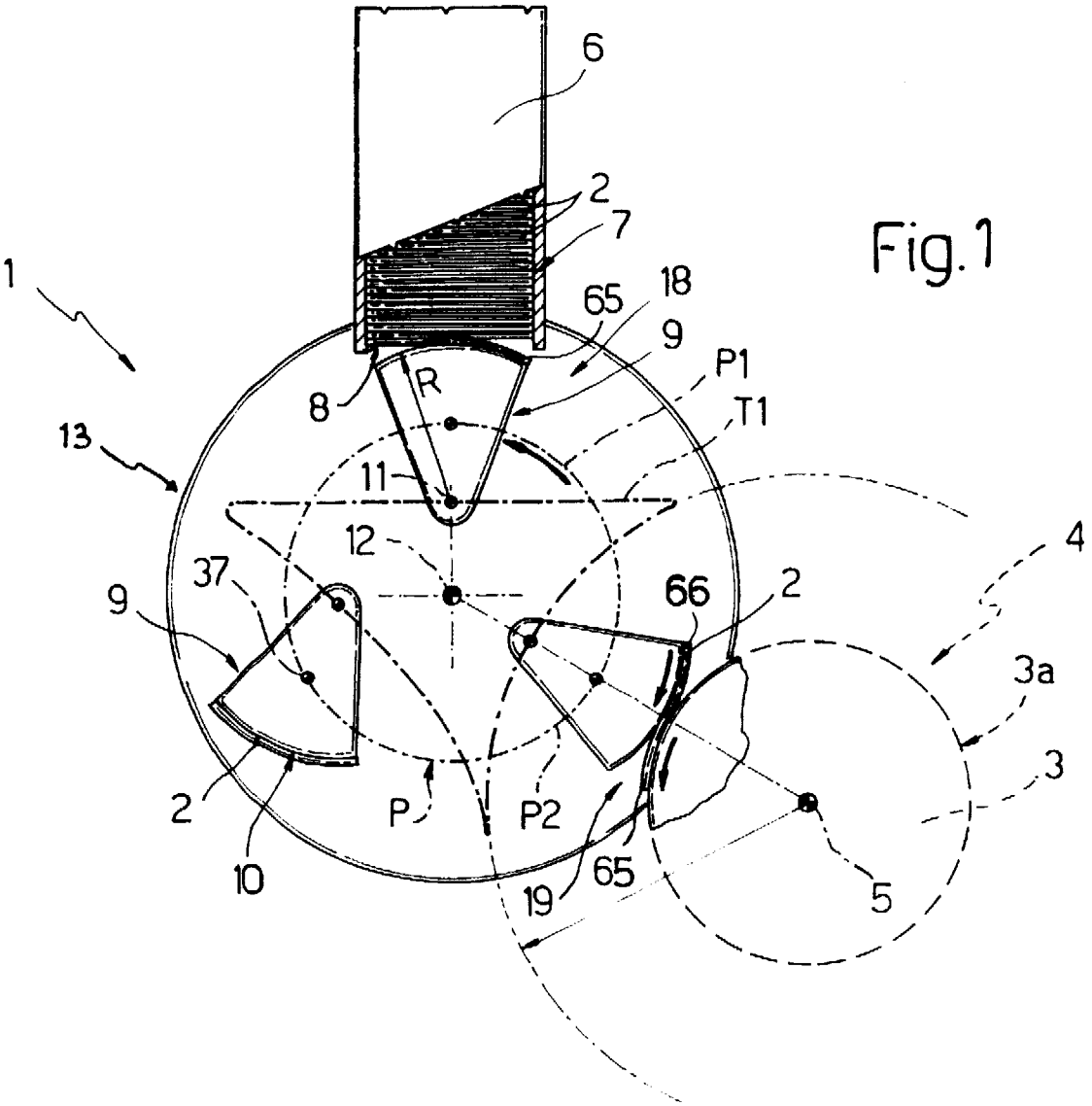
FIG. 1 shows, schematically and with parts removed for clarity, a continuous supply unit implementing the method according to the present invention.

Number 1 in FIG. 1 indicates a continuous supply unit for successively feeding wrapping elements 2 in sheet form to a roller 3 defining the input conveyor of a wrapping machine indicated as a whole by 4. Roller 3 presents a substantially cylindrical conveying surface 3*a* coaxial with an axis 5 perpendicular to the FIG. 1 plane, and moving continuously at substantially constant angular speed W1 and anticlockwise about axis 5 to successively receive elements 2.

Unit 1 comprises a feedbox 6 housing a stack 7 of elements 2 with their longer longitudinal axis parallel to axis 5, and which presents a substantially horizontal output end 8 for elements 2. Unit 1 also comprises at least one gripping member defined by a substantially cylindrical body 9 presenting an outer cylindrical gripping surface 10 coaxial with an axis 11 parallel to axis 5, and which provides for withdrawing a respective element 2 from feedbox 6 and releasing it onto conveying surface 3*a*. In the FIG. 1 embodiment, unit 1 comprises three bodies 9 equally spaced about an axis 12 parallel to axis 5, and which are fed, in use, along a given path P at substantially constant angular speed W2 by a conveying device 13 forming part of unit 1.

Figure 2:
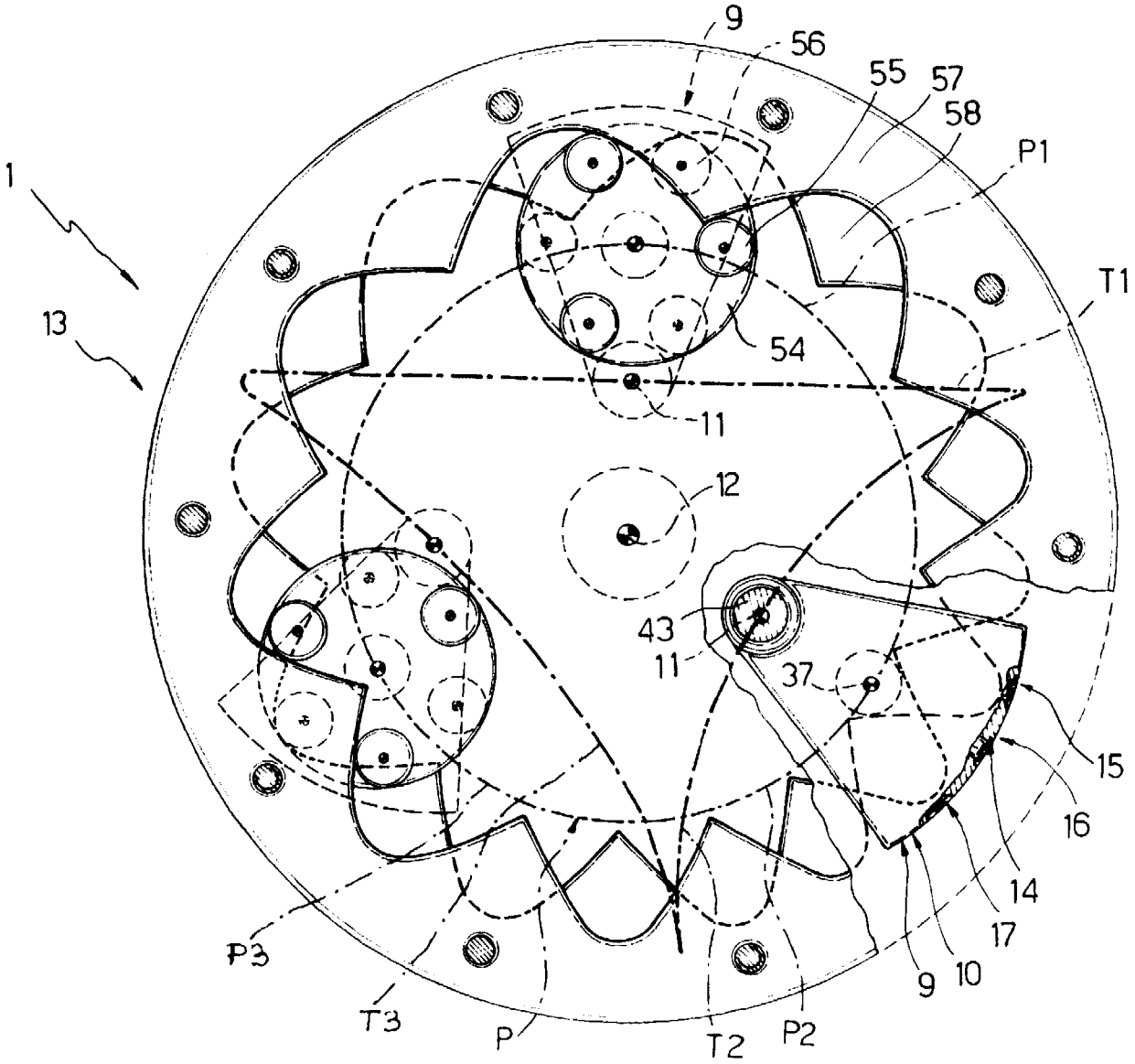
FIG. 2 shows a larger-scale view, with parts in section and parts removed for clarity, of a detail in FIG. 1.
Figure 3:
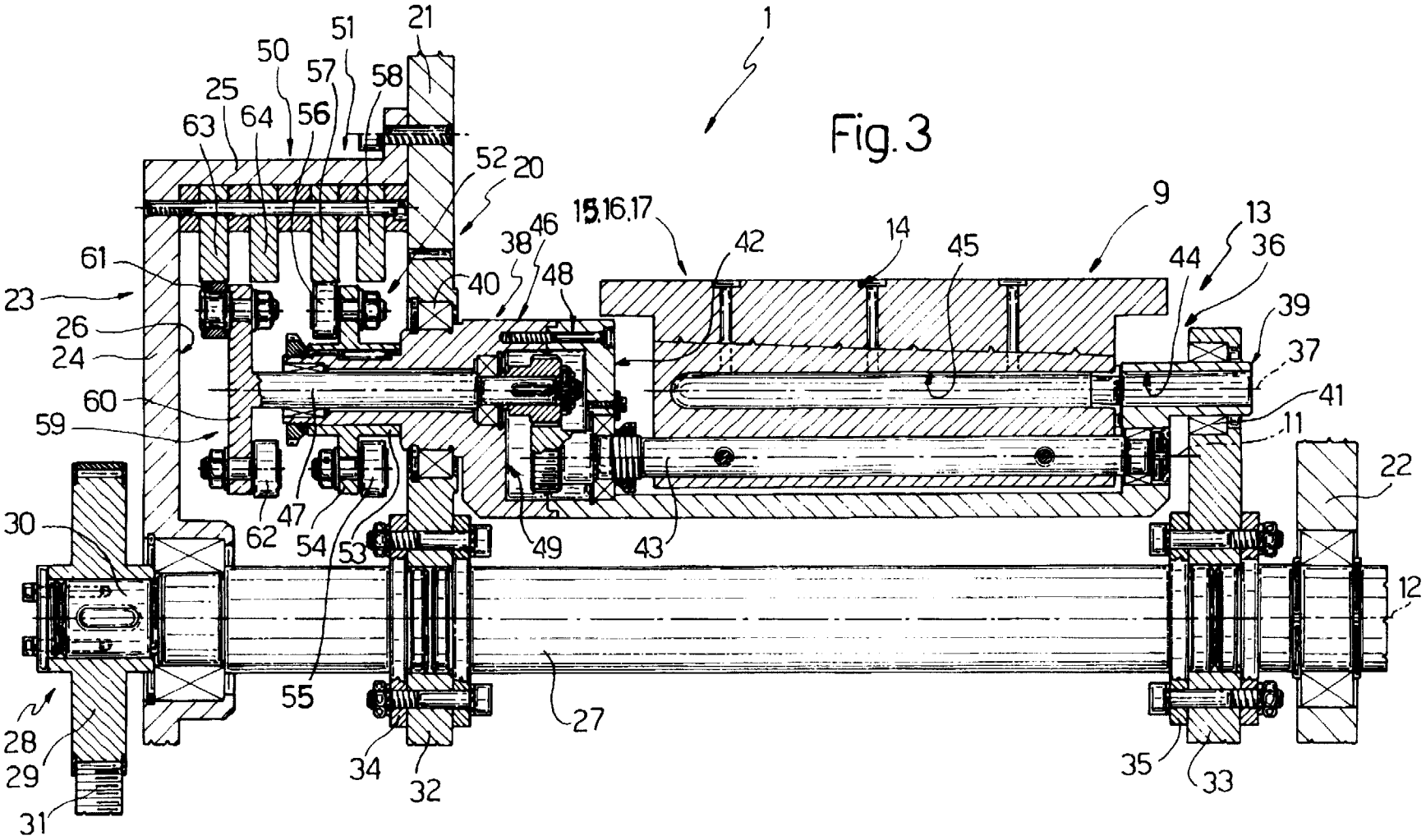
FIG. 3 shows a longitudinal section of the FIG. 2 detail.

As shown more clearly in FIGS. 2 and 3, surface 10 of each body 9 presents a number of suction holes 14 arranged in at least three rows 15, 16, 17 aligned with one another and parallel to respective axis 11; and holes 14 communicate with a known suction device (not shown) for progressively withdrawing, by suction through holes 14, a respective element 2 from output end 8 of feedbox 6, and for retaining element 2 on surface 10.

Device 13 provides for feeding each body 9 along path P, which extends in a circle about axis 12 and through a loading station 18 located at output end 8 of feedbox 6 and defining an input portion P1 of path P, and through an unloading station 19 located at roller 3 and defining an output portion P2 of path P.

As shown in FIG. 3, device 13 is fitted to a frame 20 comprising two walls 21, 22 perpendicular to axis 12; and a cup-shaped body 23 fitted outwards of and with its concavity facing wall 21. Cup-shaped body 23 in turn comprises an end wall 24 crosswise to axis 12; and a cylindrical wall 25 coaxial with axis 12 and which, together with walls 24 and 21, defines a chamber 26.

Conveying device 13 comprises a shaft 27 extending in rotary manner and coaxially with axis 12 through walls 21, 22, 24, and which is rotated about axis 12 at angular speed W2 by a belt transmission 28 located outside chamber 26 and comprising an output pulley 29 fitted to the free end 30 of shaft 27, and a toothed belt 31 looped about pulley 29 and about a further drive pulley (not shown). Device 13 also comprises a flange 32 fitted to shaft 27 at wall 21 of frame 20 by means of a known joint 34; and a flange 33 fitted to shaft 27, between walls 21 and 22 and facing wall 22, by means of a further known joint 35.

For each body 9, device 13 also comprises a cradle 36 supported by and in the space between flanges 32 and 33 so as to rotate about its own axis 37 parallel to axis 11, and which is rotated by device 13 at angular speed W2 about axis 12 so that respective axis 37 moves parallel to itself along path P.

Cradle 36 presents two tubular end appendixes 38 and 39 coaxial with respective axis 37; appendix 38 is mounted for rotation through flange 32, via the interposition of a bearing 40, and projects partially inside chamber 26; and appendix 39 is mounted for rotation through flange 33, via the interposition of a further bearing 41.

Cradle 36 also presents a cylindrical seat 42 coaxial with axis 37 and located in a substantially intermediate position between appendixes 38 and 39, and supports respective body 9 inside seat 42 via the interposition of a shaft 43 extending coaxially with axis 11 through seat 42, and which is fitted in rotary manner to cradle 36 and in angularly-fixed manner to a bottom portion of body 9 on the opposite side of axis 37 to respective surface 10.

Cradle 36 also presents a conduit 44 formed coaxially with axis 37 through appendix 39, and communicating at one end with said known suction device (not shown), and at the other end with a further conduit 45 formed coaxially with axis 37 inside body 9 to connect holes 14 to the suction device.

Shaft 43 forms the output of an actuating device 46 for oscillating respective body 9 about axis 37, and which, in addition to shaft 43, also comprises a further shaft 47 mounted for rotation through appendix 38 and coaxial with axis 37, and a known gear train 48 interposed between shafts 47 and 43 and housed inside a cavity 49 formed in cradle 36 in an intermediate position between appendix 38 and seat 42.

Unit 1 also comprises a pair of control devices 50 and 51 housed inside chamber 26 and for respectively controlling the rotation speed W3 of bodies 9 about respective axes 11, and the angular position of bodies 9 about respective axes 37.

As shown in FIGS. 2 and 3, device 51 comprises a tappet 52 in turn comprising a tubular body 53 fitted to appendix 38 of cradle 36; an annular flange 54 integral with tubular body 53; a first set of three rollers 55 fitted for rotation to flange 54, facing wall 21, and equally spaced about axis 37; and a second set of three rollers 56 fitted for rotation to flange 54 on the opposite side of flange 54 to rollers 55, and offset angularly by a given spacing in relation to rollers 55.

Device 51 also comprises a pair of known lobed cams 57 and 58 fitted side by side to wall 25 inside chamber 26, angularly offset in relation to each other by a length equal to said given spacing, and respectively engaged in rolling manner by rollers 55 and 56. More specifically, each cam 57, 58 is engaged by at least one respective roller 55, 56, and selectively by a second roller 55, 56, so that the number of rollers 55, 56 simultaneously contacting cams 57, 58 is always equal to three.

Cams 57 and 58 present the same inner profile, and are so designed that, when, in use, axes 37 of bodies 9 travel along portion P1 of path P, respective axes 11 travel along a trajectory T1 parallel to and separated from output end 8 of feedbox 6 by a distance equal to the radius of curvature R of surface 10 of bodies 9; and, when, in use, axes 37 of bodies 9 travel along portion P2 of path P, respective axes 11 travel along a further, circular, trajectory T2 coaxial with axis 5 of roller 3 and separated from surface 3*a* by a distance equal to radius R.

Device 50 comprises a tappet 59, in turn comprising a plate 60 fitted integral with the free end of shaft 47 and crosswise to axis 37; a first set of three rollers 61 fitted for rotation to plate 60, facing wall 24, and equally spaced about axis 37; and a second set of three rollers 62 fitted for rotation to plate 60 on the opposite side of plate 60 to rollers 61, and angularly offset by a further given spacing in relation to rollers 61.

Device 50 also comprises a pair of known lobed cams 63 and 64 fitted side by side to wall 25 inside chamber 26 and between cam 57 and wall 24, angularly offset in relation to each other by a length equal to said further spacing, and respectively engaged in rolling manner by rollers 61 and 62. More specifically, each cam 63, 64 is engaged by at least one respective roller 61, 62, and selectively by a second roller 61, 62, so that the number of rollers 61, 62 simultaneously contacting cams 63, 64 is always equal to three.

Cams 63 and 64 present the same inner profile, and are so designed that, when, in use, axes 37 of bodies 9 travel along portion P1 of path P and respective axes 11 travel along trajectory T1 at a speed W4, the angular speed W3 of bodies 9 about respective axes 11 equals a value W3' equal to twice the value of W4, and is such as to permit respective surfaces 10 to roll along the output end 8 of feedbox 6; and, when, in use, axes 37 of bodies 9 travel along portion P2 of path P and respective axes 11 travel along trajectory T2 at a speed W5, the angular speed W3 of bodies 9 about respective axes 11 equals a value W3" equal to the value of speed W1, and is equal to twice the value of W5, i.e. is such as to permit respective surfaces 10 to roll along surface 3*a* of roller 3.

Operation of unit 1 will now be described with reference to one body 9, and as of the instant in which conveying device 13 feeds said body 9 continuously and at speed W2 through loading station 18 so that axis 37 of body 9 travels along portion P1 of path P.

As axis 37 travels along portion P1, body 9 is rotated about axis 11 by control devices 50 and 51, so that surface 10 progressively engages and rolls along output end 8 of feedbox 6 and over and in contact with an element 2 at output end 8; rows 15, 16, 17 of holes 14 progressively contact element 2; and body 9 progressively withdraws element 2 from output end 8 of feedbox 6 starting from a portion 65 of the element 2 itself.

Alternatively, replacing conduit 45 with a known pneumatic distributor (not shown), each row 15, 16, 17 of holes 14, commencing with row 15, may be connected progressively to the suction device (not shown) as surface 10 rolls along element 2, so that element 2 is only aspirated when contacted by holes 14.

Device 50 controls the angular speed W3 of body 9 about axis 11 so that, as body 9 travels along portion P1, surface 10 rolls without sliding along output end 8; and, at the same time, device 51 controls the trajectory T1 of axis 11 of body 9 so that trajectory T1 is maintained parallel to, and at a distance equal to radius R from, output end 8.

Alternatively, the controls performed by devices 50 and 51 may be effected using only one known lobed cam (not shown) for each device 50, 51, as opposed to respective pairs of cams 63, 64 and 57, 58. In which case, tappets 59 and 52 will present five rollers (not shown) similar to and in place of rollers 61 and 55, and the inner profile of the two alternative lobed cams (not shown) will be such that the rollers (not shown) permanently contacting the inner profile are always two in number. Which solution is adopted substantially depends on the operating speed and precision required.

Once element 2 is withdrawn from feedbox 6, conveying device 13 feeds body 9, still continuously and at speed W2, along an intermediate portion P3 of path P3, located between portions P1 and P2 and along which axis 11 travels along a trajectory T3 joining trajectories T1 and T2.

On engaging unloading station 19, body 9 is so oriented by devices 50 and 51 that surface 10 is positioned facing surface 3*a*. At which point, device 13 feeds axis 35 of body 9 along portion P2, and devices 50 and 51 move body 9 so that surface 10 rolls along surface 3*a*. At the same time, the suction through holes 14 is cut of f, and element 2 is released onto surface 3*a*, commencing with a portion 66 on the opposite side of the longitudinal center line of element 2 to a portion 65.

Alternatively, if conduit 45 is replaced by said known pneumatic distributor (not shown), the suction through holes 14 in rows 15, 16, 17 may be cut off progressively, commencing with row 17, as surface 10 rolls along surface 3*a*.

As body 9 travels through station 19, device 50 so regulates speed W3 of body 9 that any point on surface 10 presents the same tangential speed as any point on surface 3*a*. The speed correction imparted to body 9 as it travels through station 19 obviously differs from that imparted to it as it travels through station 18. In substantially the same way, device 51 controls the trajectory T2 of axis 11, so that T2 is maintained parallel to surface 3*a*, at a distance equal to radius R from surface 3*a*, and coaxial with axis 5.

We claim:

1. A method of continuously feeding wrapping elements in sheet form to a user machine having an input conveyor presenting a cylindrical conveying surface rotating continuously about a first axis at a substantially constant angular speed for successively receiving said elements; the method comprising:

successively and continuously withdrawing said elements from an output end of a feedbox by means of respective gripping members, each of which is provided with a relevant curved peripheral gripping cylindrical surface having a second axis; each element being withdrawn progressively from said output end by rolling the peripheral gripping surface of the respective gripping member along the output end, by moving said second axis of said respective gripping member along a first trajectory parallel to said output end and at a first speed, and by rotating said respective gripping member about the respective second axis so as to impart to the respective peripheral gripping surface a second surface speed, about said respective second axis, equal to twice said first speed;

feeding said gripping members, together with the respective elements, along a given path; and progressively releasing the elements onto said conveying surface by rolling the peripheral gripping surface of the respective gripping member on the conveying surface, by moving the second axis of the respective gripping member along a second trajectory parallel to said conveying surface, and coaxial with said first axis, and by rotating the respective gripping member about said respective second axis so as to impart to the respective peripheral gripping surface a third speed, about said second axis, equal to the speed of the conveying surface; said second axis being moved along said second trajectory at a fourth speed equal to half said third speed.

2. A method as claimed in claim 1, wherein said withdrawing step comprises the substep of progressively connecting each gripping member by suction to the respective element as the gripping member rolls along said output end.

3. A method of continuously feeding wrapping elements in sheet form to a user machine having an input conveyor presenting a conveying cylindrical surface rotating continuously about a first axis at a substantially constant angular speed for successively receiving said elements; the method comprising successively and continuously withdrawing said elements from an output end of a feedbox by means of respective gripping members, each of which is provided with a relevant curved peripheral gripping cylindrical surface having a second axis; feeding said gripping members, together with the respective elements, along a given path; and progressively releasing each element onto said conveying surface by rolling the peripheral gripping surface of the respective gripping member on said conveying surface; said rolling being obtained by moving the axis of said gripping member along a first trajectory parallel to said respective conveying surface, and coaxial with said first axis.

4. A method as claimed in claim 3, wherein each said element is withdrawn from said output end by moving the second axis of the respective gripping member along a second trajectory parallel to said output end and at a first speed, and by rotating the respective gripping member about said respective second axis so as to impart to the respective peripheral gripping surface a second surface speed, about said respective second axis, equal to twice said first speed.

5. A method as claimed in claim 4, wherein each said element is withdrawn from said output end by further progressively connecting each gripping member by suction to the respective element as the gripping member rolls along said output end.

6. A method as claimed in claim 3, wherein each said element is released onto said conveying surface by rotating the respective gripping member about said respective second axis so as to impart to the respective peripheral gripping surface a third surface speed, about said second axis, equal to a traveling speed of the conveying surface; said second axis being moved along said second trajectory at a fourth speed equal to half said third speed.

* * * * *